US006018975A

United States Patent [19]

Frigerio

[11] Patent Number: 6,018,975

[45] Date of Patent: Feb. 1, 2000

[54] MULTIPASS WIREDRAWING MACHINE WITH WIRE TENSION CONTROL DEVICE

[76] Inventor: Marco Frigerio, Via Roma, 27, 23827, Lierna, (Prov. of Lecco), Italy

[21] Appl. No.: 09/158,084

[22] Filed: Sep. 22, 1998

[30] Foreign Application Priority Data

Sep. 26, 1997 [IT] Italy ..... MI97A2197

[51] Int. Cl.[7] ..... B21C 1/10

[52] U.S. Cl. ..... 72/280; 72/289

[58] Field of Search ..... 72/280, 279, 282, 72/289

[56] References Cited

U.S. PATENT DOCUMENTS 3,812,702 5/1974 Benteler ..... 72/283
4,754,633 7/1988 Glover ..... 72/288

FOREIGN PATENT DOCUMENTS 1681994 10/1991 U.S.S.R. ..... 72/289

*Primary Examiner*—Daniel C. Crane
*Attorney, Agent, or Firm*—Guido Modiano; Albert Josif

[57] ABSTRACT

A multipass wiredrawing machine, particularly for drawing metal wires, comprising a plurality of traction drums for the wire that exits from a corresponding die, the drums being arranged mutually in succession in order to wind the wire that exits from the die and guide it on to the next die. Each traction drum is fixed with respect to the corresponding die and can move towards or away from the next die; the movement of the traction drum and of the corresponding die allows constant adjustment of the tension of the wire between the die and the drum and between the drum and the next die.

7 Claims, 4 Drawing Sheets

1
2
3
4
5
O

MULTIPASS WIREDRAWING MACHINE WITH WIRE TENSION CONTROL DEVICE

BACKGROUND OF THE INVENTION

The present invention relates to a multipass wiredrawing machine provided with a device for adjusting and controlling the tension of the wire being drawn, particularly suitable for drawing metal wires and the like.

In particular, the invention relates to multiple soap and wet wiredrawing machines.

The term "wiredrawing" refers to a form of plastic cold working consisting in the forced passage of the material through the shaped bore of a die, performed by pulling. The series arrangement of multiple dies with holes having progressively decreasing diameters allows to reduce the initial diameter to the selected size.

In order to draw metal wires the wire passes through a die, where its cross-section is reduced by plastic deformation.

Traction is applied by a traction drum which is located downstream of the die and, by rotating, winds up a certain number of turns of the wire.

In the case of multipass wiredrawing machines, this operation is repeated several times in succession, guiding the wire towards the subsequent stage; accordingly, multiple dies are provided and arranged mutually in series, and each die has a corresponding drum arranged downstream.

The wire is thus guided from one drum to the next die, with a consequent reduction in diameter between one pass and the next.

Traction must be applied because the wire being drawn, by causing friction against the traction drum, which is driven by an electric motor, allows said drum to pull it (with a capstan-like effect), wind it and then guide it on to the next drum.

Since wiredrawing occurs without removing material, i.e., with a constant volume, the ratio between the cross-section and the speed of the wire becomes particularly important and must be kept constant for each pass through the different dies and respective drums.

Accordingly, every time the wire diameter decreases, the wire becomes longer and therefore each drum has a progressively faster rotation rate in order to wind an increasingly longer wire.

The ideal situation would be one in which the wire passes directly from one drum to the next, without interposed wire tension control elements which, by acting directly on the wire, may damage it.

The basic requirement for correct operation is that the rotation rate of the individual drums must strictly match the tension changes of the wire as it leaves the respective dies, adapting to the elongations that the wire is subjected to as it passes through the various dies.

In practice, this theoretically ideal condition is difficult to achieve because it is difficult to precisely control the speeds of the individual motors that drive the drums and because of the variables that come into play during drawing, such as die wear etcetera.

In order to obviate these drawbacks, wiredrawing machines which accumulate wire between one drum and the next and, more recently, dancer-roll or bend-detector machines have been used.

These last devices are moving elements onto which the wire being drawn is guided. Any variations in the elongation of the wire produce angular or linear movements of these elements which, through position transducers, such as inductive transducers (potentiometers, encoders, etcetera) control and correct the speed of the corresponding motor, thus maintaining continuous drawing.

Conventional solutions described above, however, have the drawback that they bend the wire around the moving elements, causing bending which is sometimes excessive if obtaining optimum metallurgical characteristics for said wire is sought.

Moreover, drawbacks due to the constructive difficulties of wiredrawing machines using these solutions and difficulties in threading the machines are present.

Another solution that has been adopted recently to provide wiredrawing machines whose operation complies as much as possible with the above-described optimum condition entails controlling the speed of the individual drums by detecting wire tension changes both in the portion between the die and the drum and in the portion between the drum and the following die.

The position of the drums and of the dies is fixed; accordingly, since no moving parts are provided, control of the speed of the drum motors generates variable tensions on the wire in the portion between the drum and the next die.

Another problem that is encountered with wiredrawing machines relates to the fact that very often, due to malfunctions or to production requirements, it is necessary to exclude one or more passes of the wire through the die.

In current machines it is relatively easy to exclude a unit by acting on appropriately provided controls provided on the control console of the apparatus. In practical operation, the wire is guided onto the drum that follows the excluded drum, which remains motionless. In the case of a linear wiredrawing machine, without dancer rolls or bend detectors, one or more guiding rolls, fitted in a suitable position, are often used in order to prevent the wire from sliding against the excluded drum. Due to assembly and positioning requirements, the diameter of these rolls must be limited; accordingly, this fact entails negative aspects which affect the quality of the resulting product.

In fact, it has been observed that any contact of the wire with other elements that change its orientation produces a relative sliding which alters the layer of lubricant, i.e., stearate, on the surface of the wire, consequently varying its intrinsic characteristics.

The smaller the guiding roll or rolls used, the greater this problem becomes.

SUMMARY OF THE INVENTION

The aim of the present invention is to provide a multipass wiredrawing machine provided with a device for adjusting and controlling the wire being drawn, which allows to maintain direct traction of the wire without having to resort to devices for accumulating said wire or to dancer rolls and the like or in any case to elements for detecting the tension of the wire which must be in contact with said wire.

Within the scope of this aim, an object of the present invention is to provide a multipass wiredrawing machine having a wire traction adjustment and control device which allows to maintain constant tension on the wire in the critical pulling portion between the die and the traction drum and in the critical release portion between the drum and the next die.

Another object of the present invention is to provide a multipass wiredrawing machine which allows to draw wires made of different materials with the same machine.

Another object of the present invention is to provide a multipass wiredrawing machine which has a minimal number of components.

Another object of the present invention is to provide a multipass wiredrawing machine which is highly reliable, relatively easy to provide and at competitive costs.

This aim, these objects and others which will become apparent hereinafter are achieved by a multipass wiredrawing machine, particularly for drawing metal wires, which comprises a plurality of traction drums for the wire that exits from a corresponding die, said drums being arranged mutually in succession in order to wind the wire that exits from the die and guide it on to the next die, characterized in that each traction drum is fixed with respect to the corresponding die and can move towards or away from the next die, the movement of the traction drum and of the corresponding die allowing constant adjustment of the tension of the wire between the die and the drum and between the drum and the next die.

BRIEF DESCRIPTION OF THE DRAWINGS

Further characteristics and advantages of the present invention will become apparent from the following detailed description of a preferred but not exclusive embodiment of the multipass wiredrawing machine according to the invention, illustrated only by way of non-limitative example in the accompanying drawings, wherein.

DESCRIPTION OF THE PREFERRED EMBODIMENTS

Figures 2, 3:
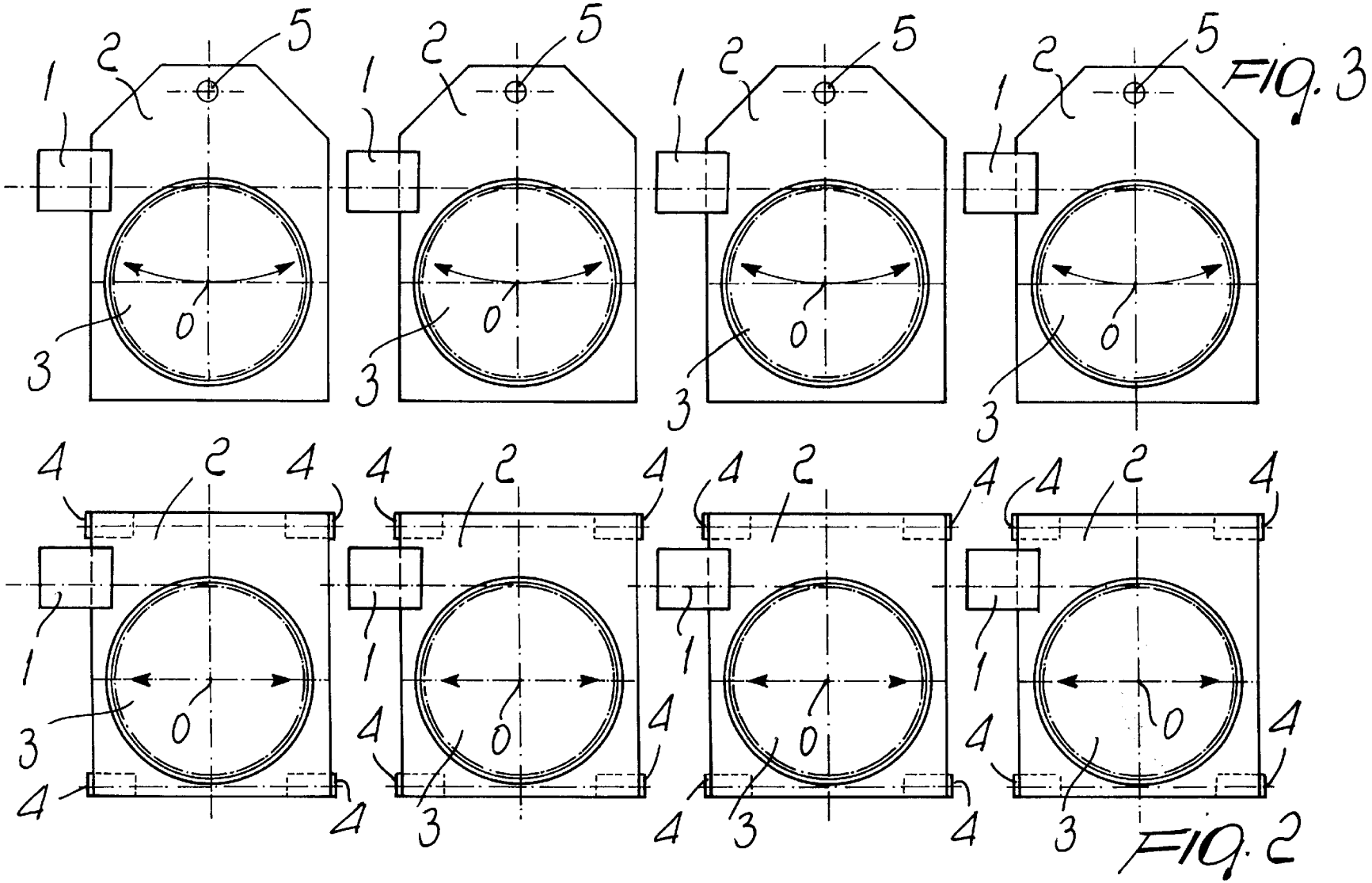
FIG. 2 is a schematic front view of a first embodiment of the multipass wiredrawing machine according to the present invention.
FIG. 3 is a schematic front view of a second embodiment of the multipass wiredrawing machine according to the present invention.

A first embodiment of the multipass wiredrawing machine according to the present invention is illustrated with reference to FIGS. 1 and 2 and comprises a plurality of dies 1, each of which is supported by a supporting frame 2 whereon a traction drum 3 is provided which is constituted by a cylindrical body which can rotate about a central axis 0. The frame 2, as shown in FIG. 2, is supported by means of straight guides 4 by the fixed frame (not shown) of the wiredrawing machine according to the invention. The cylindrical body drum 3 is thus capable of moving transversely with respect to the central point 0 by moving along the guides 4.

The straight guides 4 can of course be replaced with similar systems which allow a transverse movement of the body 3 with respect to the central axis 0.

FIG. 3 illustrates a second embodiment of the wiredrawing machine according to the present invention, wherein, differently from the first embodiment, the frame 2 is supported by means of bearings 5 for connection to the fixed frame (not shown) of the wiredrawing machine, allowing the traction drum 3 and the corresponding die 1, rigidly coupled thereto, to perform an oscillating or pendulum-like movement, moving the unit constituted by the drum and the die.

For both of the above-described embodiments there are provided different possible systems for transmitting the motion from the electric motor (not shown) of the traction drum to the drum itself, according to the speed and traction force that the drum 3 must apply.

In particular, and by way of example, the following types of transmission are possible:

- direct drive between the motor and the drum;
- drive using trapezoidal or toothed belts between the motor and the drum;
- drive using a gear reduction unit between the motor and the drum;
- mixed drive using a gear reduction unit and trapezoidal or toothed belts between the motor and the drum and the reduction unit.

As an alternative, it is possible to use, as device for final transmission to the drum 3, a universal-joint drive which transmits exclusively a torque but no transverse stress to the drum, making the position of the drum 3 entirely neutral.

Figure 4:
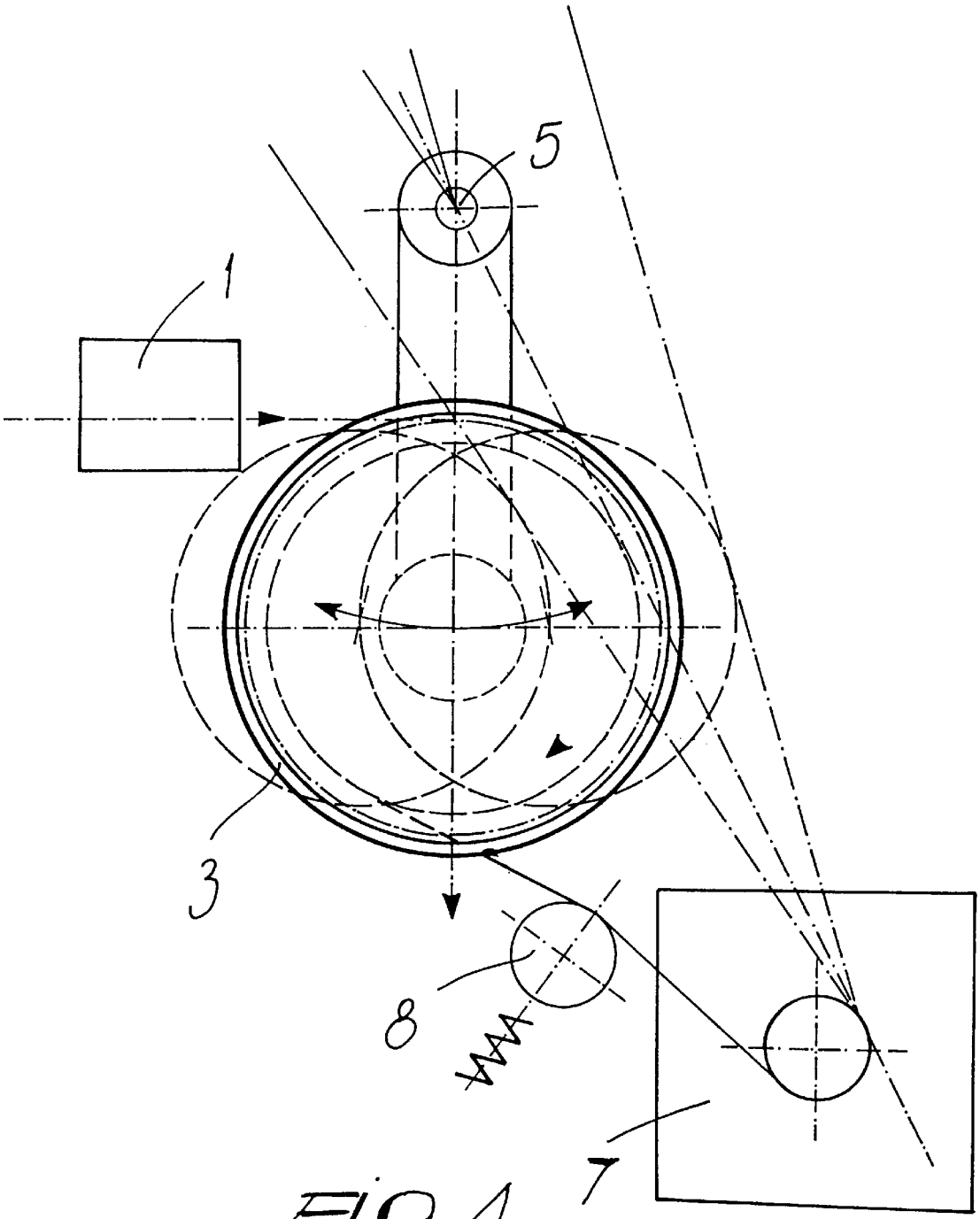
FIG. 4 is a view of an example of transmission between the drum actuation motor and the drum itself, in the wiredrawing machine according to the invention.
Figure 5:
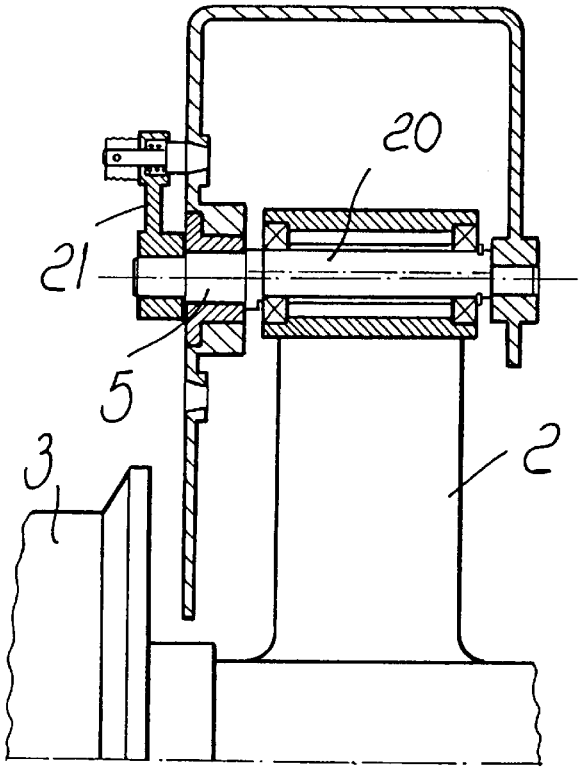
FIG. 5 is a view of a unit for moving the traction drum.
Figure 6:
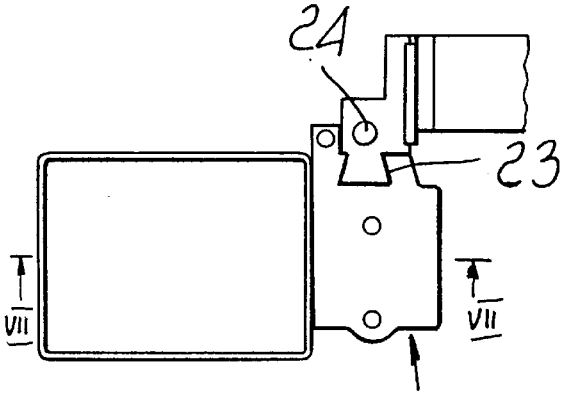
FIG. 6 is a schematic plan view of the die, illustrating the die shifting element.
Figure 7:
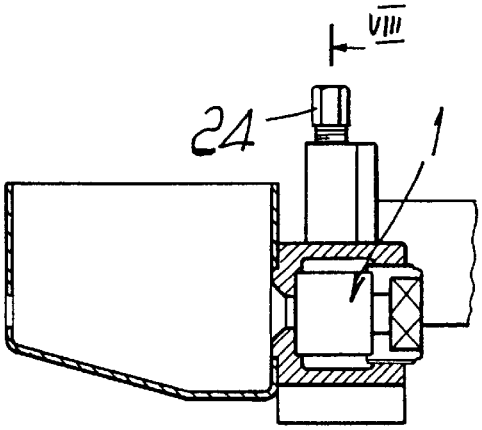
FIG. 7 is a sectional view, taken along the plane VII—VII of FIG. 6.
Figure 8:
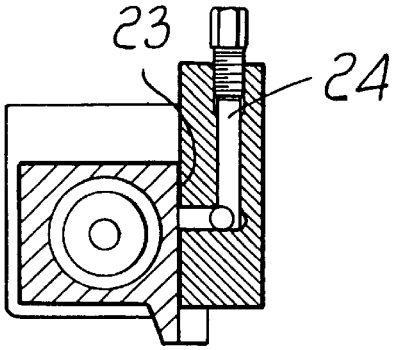
FIG. 8 is a sectional view, taken along the plane VIII—VIII of FIG. 7.

FIG. 4 is a schematic view of an example of transmission between the motor and the drum in which trapezoidal or toothed belts are used. The reference numeral 7 designates the drum actuation motor and the reference numeral 8 designates a tensioner for the transmission belt.

The drum shown in FIG. 4 is of the type with a pendulum-like motion and is supported by the pivot 5.

For both of the above-described embodiments, the movement of the entire unit constituted by the traction drum 3 and by the corresponding die activates a position sensor 6, which is conveniently constituted for example by an inductive transducer, a potentiometer, a proximity sensor, an encoder, etcetera, and acts on the control elements of the motor 7 of the drum 3, adjusting its rotation rate.

With reference to the above figures, the operation of the wiredrawing machine according to the invention is as follows.

Figure 1:
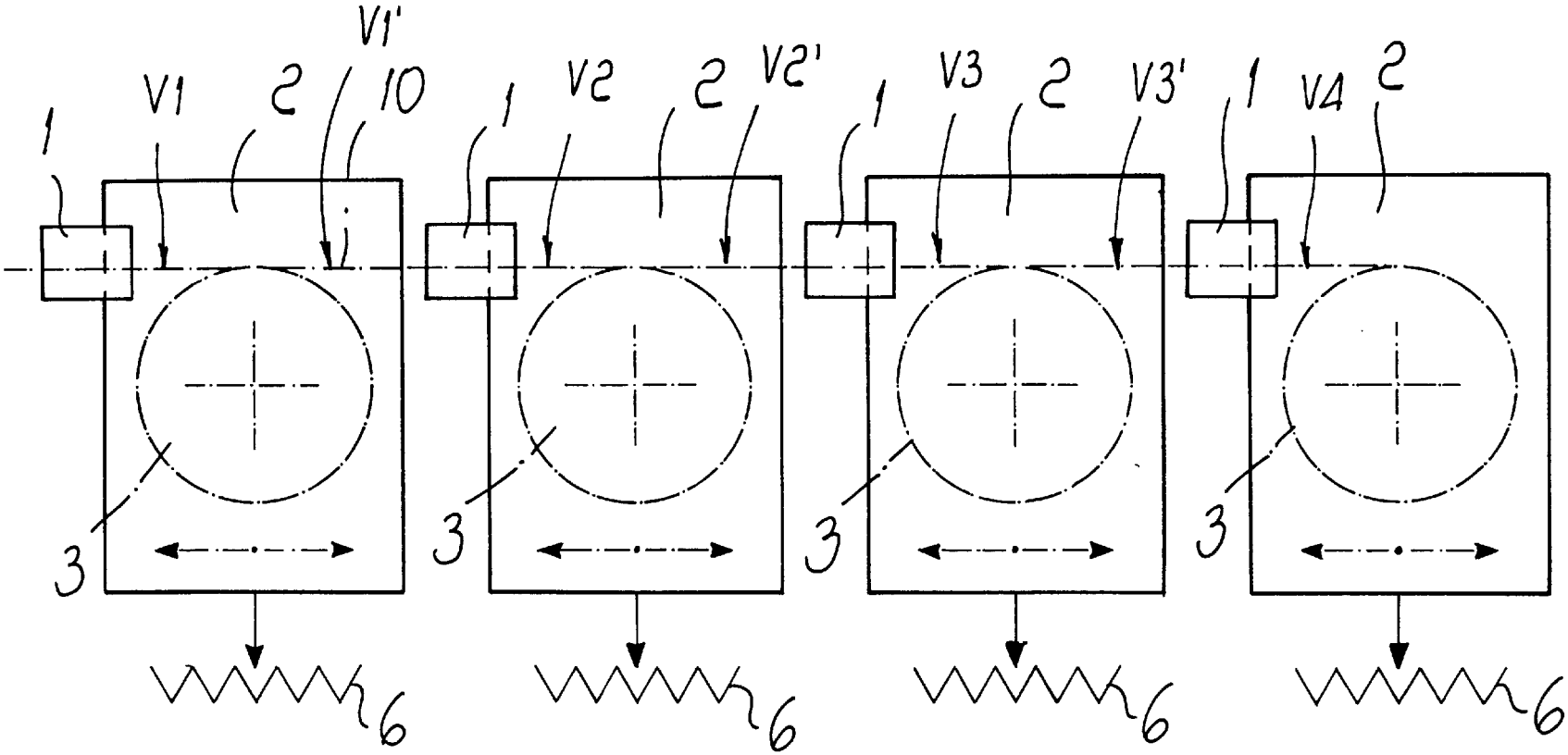
FIG. 1 is a schematic front view of the multipass wiredrawing machine according to the present invention.

With reference in particular to FIG. 1, the reference numeral 10 designates the wire being drawn, which passes through the die 1 and is wound onto the cylindrical body of the traction drum 3.

V1 designates the speed of the wire 10 in the portion between the die 1 and the drum 2 and V1' designates the speed of the wire 10 in the portion between the traction drum 2 and the next die 1.

The respective speeds V2, V2', V3, V3' and V4 are designated in the same manner for the subsequent drums 2.

The following conditions must occur in order to achieve correct operation of the wiredrawing machine:

- at the speed V, the tension between the die 1 and the drum 3 must remain constant;
- in the portion between the drum 3 and the next die 1, the speed V' must be equal to the speed V in the preceding portion.

In order to maintain constant tension of the wire 10 in all of the portions of the wiredrawing machine, a traction drum must be synchronized with the preceding traction drum and with the traction drum that follows, so as to have no variations in the speeds V and V' (where V and V' designate the speeds, for a generic drum, in the portions before and after the drum, respectively).

The synchronization speed is assuredly maintained, so that the various drums 3 remain at the middle position 0, through the lateral movement of the generic drum 3 towards or away from the drum 3 that precedes it (i.e., in one direction or the other with respect to the midpoint 0, which is the reference point for the synchronization speed).

The movement of the drum 3 activates, by means of the detection means 6, a signal which, by acting on adjustment means (not shown) of the motor 7, adjust its rotation rate, restoring synchronization among the various traction drums 3 and accordingly returning the drum at the midpoint 0.

Means which allow to move the drum 3 when it is necessary to exclude a drum-die unit are described with reference to FIGS. 5 to 8.

Said means are constituted by an eccentric element 20 which is placed on the supporting shaft or pivot 5 of the frame 2. The pivot 5 is connected to an arm 21 which can be placed in two mutually diametrically opposite positions so as to produce a translatory motion of the peripheral region of the traction drum 3, thus avoiding contact with the wire which must bypass the excluded drum.

The die unit is moved upward simultaneously with the downward translatory motion of the drum and in any case remains connected to the frame 2 at all times, avoiding any uncoupling and disassembly.

These maneuvers are performed very quickly and without particular equipment since the die, again designated by the reference numeral 1, is connected by means of vertical dovetail guiding elements 23 whereon an actuation pivot 24 is provided which allows to perform the translatory motion and the consequent disengagement.

In practice, it has been observed that the wiredrawing machine according to the invention fully achieves the intended aim, since it allows to achieve constant adjustment of the tension between the die and the drum and the next die without the aid of dancer rolls or sensors or similar systems for detecting variations in wire tension.

The wiredrawing machine thus conceived is susceptible of numerous modifications and variations, all of which are within the scope of the inventive concept.

All the details may also be replaced with other technically equivalent elements. Thus, for example, the various figures illustrate a multipass wiredrawing machine with drums having a horizontal axis: however, it is also possible to use drums having a vertical axis, stacked horizontal drums, vertical drums arranged in a step-like configuration, etcetera.

In practice, the materials employed, so long as they are compatible with the specific use, as well as the dimensions, may be any according to requirements and to the state of the art.

The disclosures in Italian Patent Application No. MI97A002197 from which this application claims priority are incorporated herein by reference.

What is claimed is:

1. A multipass wiredrawing machine, particularly for drawing metal wires, comprising mounted on a frame thereof: a plurality of dies; a plurality of traction drums for traction of wire that exits from a respective die, said drums being arranged in succession in order to wind each one the wire that exits from the respective die and to further guide the wire on to a next die, each said traction drum being fixed with respect to a corresponding said die and each drum and corresponding die being movable with respect to a next drum and corresponding die so as to be movable toward and away from the next die; and adjustment means for providing movement of each said traction drum and corresponding die with constant adjustment of wire tension between the respective die and drum and between the respective drum and the next die.

2. The multipass wiredrawing machine of claim 1, wherein said traction drum comprises a cylindrical body which is rotatable about an axis thereof and is supported by said frame of said wiredrawing machine, said rotatable body being movable about a reference midpoint.

3. The wiredrawing machine of claim 2, wherein said traction drum, together with the corresponding die, are transversely movable with respect to said traction drum axis, to adjust the tension of the wire being drawn.

4. The wiredrawing machine of claim 2, wherein said traction drum, together with the corresponding die, are movable in a pendulum-like fashion about said traction drum axis so as to provide an oscillating motion for adjusting the tension of the wire that is fed into the next die.

5. The wiredrawing machine of claim 2, comprising guiding elements provided at said frame, the cylindrical body of said traction drum being guidingly supported by said guiding elements.

6. The wiredrawing machine of claim 2, comprising pivot means provided at said frame, the cylindrical body of each said traction drum being supported by a respective said pivot.

7. The wiredrawing machine of claim 1, comprising detection means for detecting a position of each of said drum, said detection means being adapted to actuate said adjustment means for adjusting a rotation rate of said drum as a function of a detected position.

* * * * *